United States Patent [19]

Ammann

[11] Patent Number: 4,635,426

[45] Date of Patent: Jan. 13, 1987

[54] DEVICE FOR BRIDGING THE JOINT BETWEEN TWO PARTS OF A ROOF AND METHOD FOR TESTING ITS TIGHTNESS

[76] Inventor: Ernst Ammann, Baltenswilerstrasse #127, CH8360 Wallenwil, Switzerland

[21] Appl. No.: 619,860

[22] Filed: Jun. 12, 1984

Related U.S. Application Data

[63] Continuation-in-part of Ser. No. 421,570, Sep. 22, 1982, abandoned.

[30] Foreign Application Priority Data

Oct. 6, 1981 [CH] Switzerland ..... 6418/81

[51] Int. Cl.[4] ..... E04B 1/62

[52] U.S. Cl. ..... 52/573

[58] Field of Search ..... 52/573, 396

[56] References Cited

U.S. PATENT DOCUMENTS 4,071,994 2/1978 Ammann ..... 52/573

4,202,201 5/1980 Johnson ..... 73/40

FOREIGN PATENT DOCUMENTS 2531695 3/1977 Fed. Rep. of Germany ..... 52/573

2722139 4/1978 Fed. Rep. of Germany ..... 52/573

*Primary Examiner*—James L. Ridgill, Jr.

*Attorney, Agent, or Firm*—Tilton, Fallon, Lungmus & Chestnut

[57] ABSTRACT

An expansion joint unit is made up of two side sections and an expansion joint strip made of a resilient material and bridging the joint with its center portion. The edge portions of the expansion joint strip are vulcanized to the side sections. Disposed between the expansion joint strip and the side portions are separating strips defining chambers which are inflatable by way of openings.

According to the method, a pump and/or pressure gauge is connected to the openings for supplying compressed air to the closed space and the pressure is observed over a period of time. A drop in pressure is a clear indication of a defective expansion joint element.

7 Claims, 8 Drawing Figures

DEVICE FOR BRIDGING THE JOINT BETWEEN TWO PARTS OF A ROOF AND METHOD FOR TESTING ITS TIGHTNESS

CROSS REFERENCE TO A RELATED APPLICATION

This is a continuation-in-part application of U.S. Pat. Ser. No. 421,570 filed Sept. 22, 1982 now abandoned.

BACKGROUND OF THE INVENTION

This invention relates to a device for bridging the gap or opening between two composite parts of roofing. The device consists of an expansion joint strip, the center section of which is made of a rubber elastic material and is placed in the joint, while the two side sections, being made of sheet metal to which the edges of the center section are vulcanized in a waterproof manner, are adhered to the portions of the roofing on either side of the joint. The invention further relates to a method of testing the device for tightness.

Device of the foregoing type are known from Swiss Patent CH-PS No. 456.106 (METOBA ANSTALT) and are sold commercially under the generic term of "dilatation element".

Although dilatation elements of this type have proven their merit a hundred thousand times, defects do occasionally occur and they may have a variety of causes. In addition to defects caused by mechanical damage, chemical decomposition, disintegration due to the impact of UV radition, and production errors in the vulcanization process resulting in the formation of blisters and insufficient adhesive properties, the majority of defects that occur are due to improper installation.

Since the causes for the various defects are known, a number of suggestions to avoid damage have been made in the past. In particular, suggestions have been advanced to guard against mechanical and chemical destruction and against the effects of ultraviolet radiation. The following publications deal with matters of this kind: DE-OS No. 17 59 246 (Schoop), DE-GM No. 70 44 967 (Wetra-Trachsel & Co.) and DE-OS No. 20 18 309 and DE-AS No. 25 31 695 (E. Ammann AG). The German Pat. No. 25 31 695 corresponds to U.S. Pat. No. 4,071,994.

No protection, however, has so far been available against faulty installation. In particular, the careless handling of blow torches has been found time and again to be the cause of damage to the rubber elastic center section. This has given rise to the need to inspect the expansion joint element after completion of the installation.

German public disclosure DE-OS No. 41 365 (Schoop) proposes a detachable cover or lid to make visual inspection possible in the event of damage. To this end, the cover needs to be detached from the dilatation element proper and later be returned to it and reattached by cementing or soldering. Quite apart from the fact that the rubber elastic center portion may easily be destroyed as the cover is reattached to the dilatation element, this prior art proposal, as previously mentioned, merely affords a visual inspection from above. Frequently, however, an unsatisfactory adhesion of the rubber elastic material forming the center section to the sheet metal side sections is invisible to the eye. This is particularly true of detachments occurring at the under side of the sheet metal sections, and where leaking is caused by blister formation in the rubber elastic center section. It was to overcome these defects that the present invention was conceived.

DESCRIPTION OF THE PRIOR ART

Applicant is aware of the Ammann U.S. Pat. No. 4,071,994 and the Johnson U.S. Pat. No. 4,202,201, both of which are cited in the parent application. In U.S. Pat. No. 4,071,994, the openings 5' serve to hold the metallic cover strip 2' overlaying the gap and protecting the rubber against mechanical damage and ultra violet rays whereas in the present invention, the bonding of the rubber center portion can be tested after vulcanization. Also, applicant has introduced a separating strip not present in the patented structure.

The Johnson patent relates to a dust sealing door with integral testing means. Johnson is directed to a dust and soundproof room wherein the door is provided with a seal on the bottom thereof to provide an isolation door. He also provides for testing the seal but he has no separating strip between the door and rubber and has no vulcanizing of the rubber to the lateral sides of the two metal strips.

SUMMARY OF THE INVENTION

It is the object of the present invention to provide a device for bridging or covering the joint between two surface sections of roofing, whereby the device is amenable to being tested for tightness in an easy and safe way after installation.

This is accomplished according to the invention by a device which is characterized in that at least along the lateral joint edges and at least approximately along their entire length, in the area in which the rubber elastic expansion joint strip is vulcanized to the side sections, narrow separating strips sealingly enclosed by the vulcanized expansion joint strip are adhered to the side sections, and that at least one opening extends from the separating strip to the atmosphere.

The device according to the invention is capable of being tested for tightness at any time by the testing method, likewise in accordance with the invention. The method steps are:

(a) Insertion of the nozzle of a combination pump and pressure gauge into the opening leading to the separating strip.

(b) Introduction of air into the space between the separating strip and the expansion joint strip.

(c) Observation of the pressure building up in the closed space.

The invention will be described in further detail with reference to some of its embodiments as illustrated in the drawings, and the testing method will likewise be discussed in further detail hereinbelow.

IN THE DRAWINGS

DETAILED DESCRIPTION OF THE DRAWINGS

Figure 1:
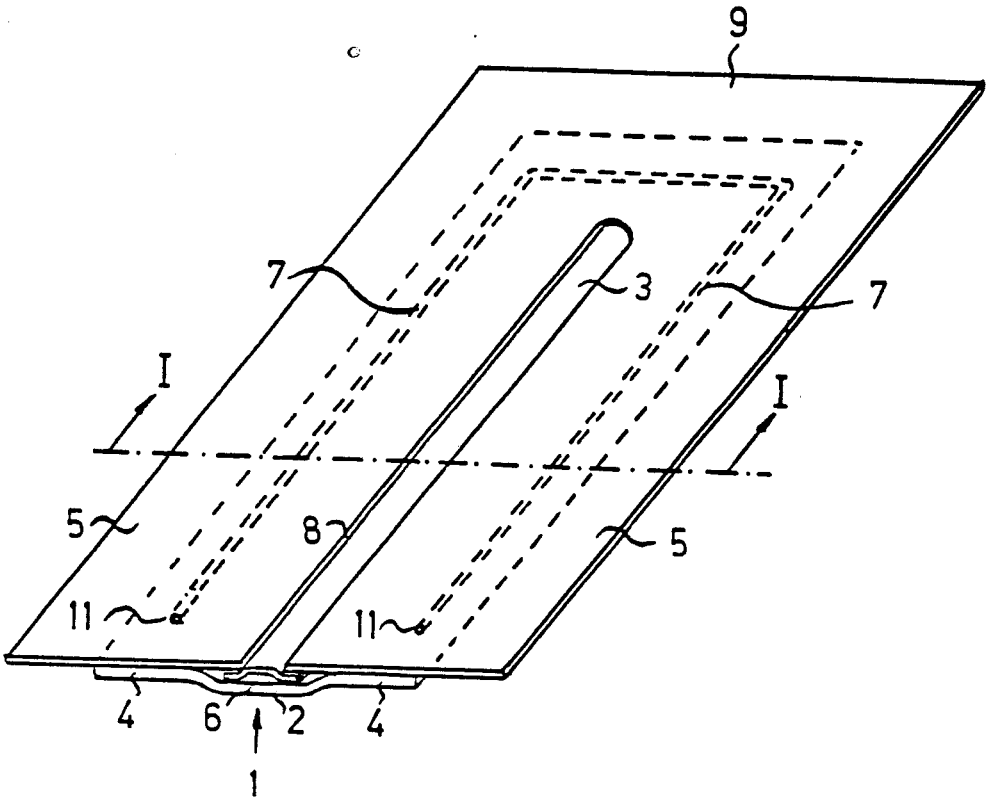
FIG. 1 is a perspective view of an expansion joint element with a built-in cover member.
Figure 2:
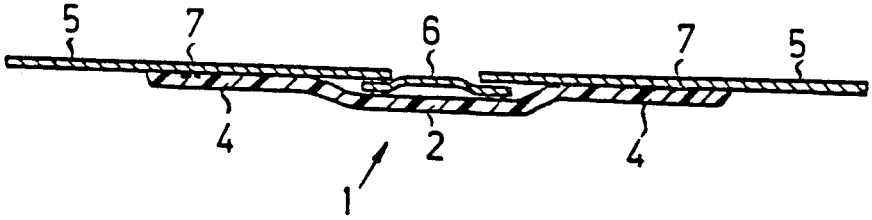
FIG. 2 is a sectional view along the line I—I of FIG. 1.
Figure 8:
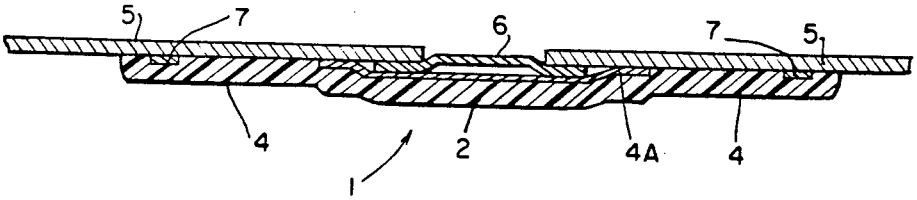
FIG. 8 is a greatly enlarged, vertical, cross-sectional view taken on the line I—I of FIG. 1.

The expansion joint element of FIGS. 1 and 2 is generally of the structural type disclosed in German patent application DE-AS No. 25 31 695, corresponding to U. S. Pat. No. 4,071,994.

Figure 6:
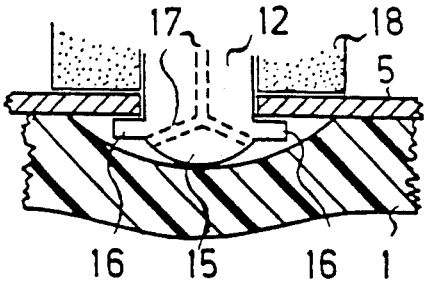
FIG. 6 is a section through the opening along the line V—V of FIG. 5 with a part of the pump inserted.

More specifically, the device for closing or bridging the gap or joint between two composite parts of roofing consists of an expansion joint strip generally designated 1 made of a rubber elastic material. The gap 3 in the roofing is covered by the mid or central portion 2 of the expansion joint strip 1. The flanges 4 of the expansion joint strip 1 are vulcanized from below to the side sections 5. To prevent bonding of the cover strip 6 to the vulcanizable flanges 4, a paper layer 4*a* is provided. (See FIG. 6.) Placed upon the center portion 2 of the elastic material is a cover strip 6 of sheet metal which is in part overlapped by the two side sections 5. In the area of the flanges 4 of the expansion strip 1, the side sections 5 are provided with separating strips or spacers 7 to prevent an intimate engagement between the flanges 4 of the expansion joint strip 1 and the side sections 5. The spacers 7 run parallel with the edges 8 of the joint, beginning a few centimeters from the end of the joint and ending approximately at the head of the expansion joint element. In the illustrated embodiment, however, the two separating strips or spacers 7 are interconnected by a piece of separating strip 9 extending perpendicular to the longitudinal direction of the strips 7 more particularly, the separating strips 7, 9 by virtue of preventing vulcanization of the elastic flanges 4 to the metal side sections 5 provide an air chamber for pressure testing of the integrity of the adjacent vulcanized bond.

The separating strips 7 may be made of oil paper, for example, suitable to be adhesively attached to the lower side of the side sections prior to vulcanization. The separating strips 7 may also be made of spreadable or sprayable chemical substances preventing a vulcanized bond and being capable of being applied to the proper places with the help of a template.

Figure 3:
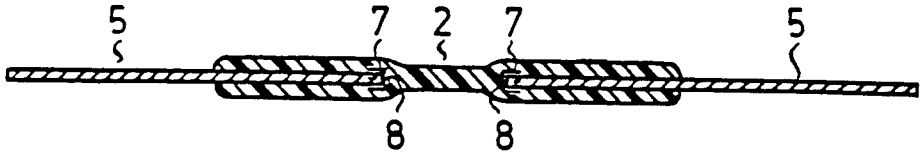
FIG. 3 is a cross-sectional view of an expansion joint element in which the rubber elastic expansion strip is vulcanized on each side to the adjacent side section.

Of similar construction is an expansion joint element which closely follows a structure described in the U.S. Pat. No. 4,071,994. In the device of FIG. 3, the two side sections 5 are engaged by the rubber elastic expansion joint strips from both sides, that is, from below and from above. The center portion 2 remains exposed and freely accessible to visual inspection.

The separating strips 7 are applied to the under side of the side sections 5.

Also in this embodiment, the separating strips 7 may be connected across the head end, while at the opposite end they stop short of the edges of the side sections 5.

In addition to the above described embodiments of the expansion joint element, other structural forms may likewise be provided with separating strips in accordance with the same principle. It is merely necessary that the separating strips extend approximately parallel to and along the entire length of the joint and define a closed space or chamber between side sections and expansion joint strip.

Figure 4:
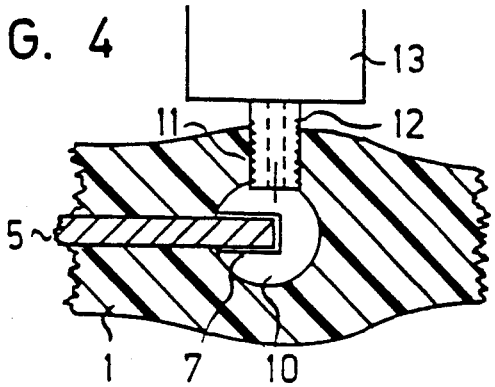
FIG. 4 is a partial sectional view, in enlarged scale, of the element of FIG. 3, with a part of a pump inserted in the opening.

This chamber, designated 10 in FIG. 4, has at least one opening, and at the most two openings, 11 leading to the atmopshere. Depending on the particular construction of the expansion joint element, the opening 11 extends either through the expansion joint strip 1 or through the side section 5. It should be understood that the vulcanizing takes place beyond the strips 7.

In one embodiment having an opening 11, the nozzle 12 of a combined pump and pressure gauge 13 is inserted into the opening. If the opening 11 extends through the rubber elastic material of the expansion joint strip 1, then it suffices for the nozzle to be of a configuration that ensures a positive sealing and proper retention. (See FIG. 4.)

Figure 5:
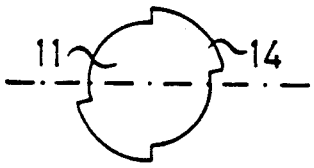
FIG. 5 shows the opening in the side section of the dilatation element of FIG. 1.

If the opening 11 leads through the sheet metal side sections 5, the nozzle 21 must be capable of being retained in the opening. Therefore, the opening 11 is provided with two arcuate segments 14 each of less than 90° but with an inner diameter in excess of the diameter of the opening proper (FIG. 5).

Fitting in this opening is the nozzle 12 having a head 15 with two projections or lobes 16. Below the projections are arranged the outlet openings of the air ducts 17. Surrounding the nozzle 12 is a gasket 18, tightly sealing off the opening 11. After rotating the nozzle 12 through 90°, the two lobes 16, which fit into the segments 14, engage the side sections 5 from below, with the result that the gasket 18 is packed into tight engagement with the side sections 5. Simultaneously, the expansion joint strip 1 is pushed slightly down by the head 15 of the nozzle 12, thereby exposing the outlet openings of the air ducts 17.

The method of testing the expansion joint element for tightness is extremely straightforward. A nozzle 12 is inserted into the opening 11 of an expansion joint element of a combined pump and pressure gauge. Thereupon, compressed air is supplied until a certain pressure is reached in the space or chamber 10 as indicated on the pressure gauge. When the pressure remains constant over a period of time, the expansion joint element is tight, whereas a drop in pressure indicates that air is escaping and that there is leaking. Providing the expansion joint element with two openings 11 will increase the reliability of the testing method.

Figure 7:
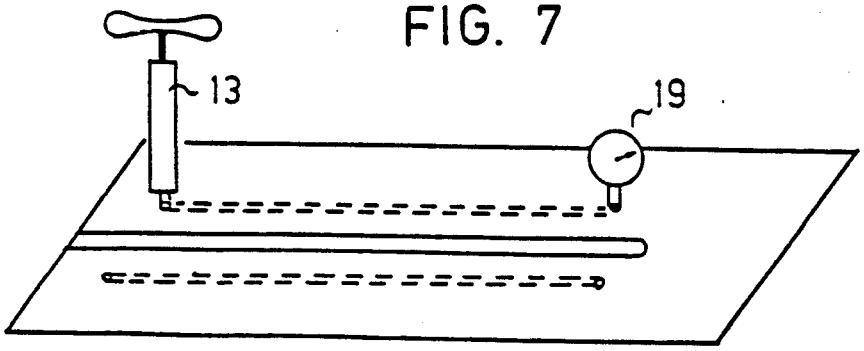
FIG. 7 is a perspective view of an illustration of the method of testing the inventive device for tightness.

FIG. 7 shows an embodiment in which the nozzle 12 of a pump 18, symbolized by a simple hand pump, is connected to an opening 11, while the second opening 11 has attached thereto a manometer, symbolized by a gauge 19, likewise by way of a nozzle 12. Again, compressed air is supplied by the pump 18 to the chamber 10 defined by the separating strips 7. As in the previously described embodiment, a pressure drop observed during a certain period of time is indicative of a leakage in the expansion joint element. On the other hand, if the pressure gauge fails to register an increase in pressure, in spite of the compressed air pumped into the chamber 10, this shows that the chamber 10 has no free passage and this may indicate either a faulty vulcanization or a defective separation strip. In the installed condition, this may also mean that the expansion joint element was bent too sharply which is likewise impermissible because sharp edges may cause damage to the expanding strip.

The device and the testing method according to the invention entail considerable advantages for the manufacturer as well as the user. First, the manufacturer is in a position to test each expansion joint element for tightness, and thus for possible manufacturing defects, prior to shipping. This initial testing especially may be carried out with a considerable pressure, whereby any hidden defects, like blister formation and insufficient adhesive properties, can easily be detected. If the expansion joint strip 1 does not firmly adhere to the side sections 5, it will become detached due to the high pressure. In the event of blister formation, the rubber elastic material will burst.

The same test can be performed by the tradesman after installation on the construction site, so that he can easily determine whether the device has been destroyed by overheating or excessive bending or folding.

Upon application of the insulating material, the test may be repeated. If now any defects become evident, it can safely be assumed that they are due to the insulating operation. Defects of this type may occur by careless working with the torch flame.

Finally, in the event of water damage to the finished flat roof, the testing method according to the invention permits to establish beyond doubt whether it was caused by a defective dilatation element, thus avoiding unnecessary removal of the expansion joint element and affording a clear cut assignment of responsibility for liability claims.

The device of the invention may take a variety of structural forms commensurate with the many structural shapes of expansion joint elements, without departing from the basic concept of forming a closed space by providing separating strips between the side sections and the expansion joint strip of an expansion joint element.

In addition to the simplest solution described herein, namely, to provide free openings 11, it is also feasible to provide valves and/or connecting means for the test instruments or pump, respectively, fixedly attached to the expansion joint element.

The described nozzle, pump and pressure gauge means have been included for the sake of completeness only. The testing means, i.e., pump, pressure gauge and connecting members, do not form a part of the invention.

Finally, it may be mentioned that the testing medium, in addition to compressed air, may also be water or any other low viscosity medium.

I claim:

1. In a roofing structure, a device for bridging a juncture between two composite parts of said roofing structure in the form of an expansion joint comprising:

two sheet metal side portions providing a gap positioned between said side portions, a rubber elastic material bridging said gap and equipped with flanges bondingly vulcanized in a waterproof manner to said sheet metal side portion, said expansion joint element being connected to the roofing structure extending on both sides of said expansion joint, a narrow separating strip secured to each of said side portions and being arranged between each of said metal side portions and the flanges of said rubber elastic material to interrupt the vulcanized bond between the rubber elastic material and the sheet metal side portions and provide a chamber for pressure testing said vulcanized bond, the length of said narrow separating strips extending approximately over the full length of said flanges, and at least one opening conductively leading out of said narrow separating strip to the atmosphere for pressuring said chamber for pressure testing the said vulcanized bond.

2. A device according to claim 1, characterized in that the rubber elastic expansion joint is bondingly vulcanized both to the upper and the lower side of said metal side portions and that the narrow separating strips are arranged on both sides of said metal side portions.

3. A device according to claim 1 characterized in that the narrow separating strip consists of a strip of a chemically treated paper bonded upon the sheet metal before vulcanization of the rubber elastic material thereto.

4. A device according to claim 1 characterized in that the narrow separating strips are bonded to said side sections and are connected to each other at one end thereof.

5. A device according to claim 2 characterized in that the free ends of the connected narrow separating strips are provided with openings leading to the atmosphere.

6. A device according to claim 1 characterized in that the narrow separating strips are positioned approximately medially of the bonding area and that said opening leads from at least one of said narrow separating strips through the adjacent side section to the atmosphere.

7. A device according to claim 6 characterized in that said opening is in the form of a cylindrical bore with at least two lateral recesses therein.

* * * * *